US011135732B2

(12) United States Patent
Ohara et al.

(10) Patent No.: US 11,135,732 B2
(45) Date of Patent: Oct. 5, 2021

(54) ROTARY ELECTRIC SHAVER

(71) Applicant: Maxell Izumi Co., Ltd., Matsumoto (JP)

(72) Inventors: Toshihiko Ohara, Matsumoto (JP); Kenichi Karasawa, Matsumoto (JP)

(73) Assignee: MAXELL IZUMI CO., LTD., Matsumoto (JP)

( * ) Notice: Subject to any disclaimer, the term of this patent is extended or adjusted under 35 U.S.C. 154(b) by 0 days.

(21) Appl. No.: 17/012,882

(22) Filed: Sep. 4, 2020

(65) Prior Publication Data

US 2021/0122068 A1 Apr. 29, 2021

(30) Foreign Application Priority Data

Oct. 28, 2019 (JP) ..... JP2019-194880

(51) Int. Cl.
*B26B 19/14* (2006.01)

(52) U.S. Cl.
CPC ..... *B26B 19/141* (2013.01)

(58) Field of Classification Search
CPC ..... B26B 19/145; B26B 19/14; B26B 19/146; B26B 19/3853; B26B 19/386; B26B 19/141; B26B 19/048; B26B 19/063; B26B 19/388; B26B 19/046; B26B 19/3846; B26B 19/143; B26B 19/20; Y10T 83/04
USPC ..... 30/42, 43.6, 527, 43.4, 43, 346.51, 43.1, 30/43.9, 43.2, 43.5
See application file for complete search history.

(56) References Cited

U.S. PATENT DOCUMENTS

| | | | | |
|---|---|---|---|---|
| 3,233,323 | A * | 2/1966 | Driessen | B26B 19/14 30/43.2 |
| 4,250,617 | A * | 2/1981 | Bakker | B26B 19/14 30/34.2 |
| 6,823,590 | B2 * | 11/2004 | Uchiyama | B26B 19/145 30/346.51 |
| 7,743,508 | B2 * | 6/2010 | Shimizu | B26B 19/14 30/43.6 |
| 2011/0030220 | A1 * | 2/2011 | Shimizu | B26B 19/145 30/43.6 |
| 2018/0222066 | A1 * | 8/2018 | Julemont | B26B 19/20 |
| 2020/0384660 | A1 * | 12/2020 | Odagiri | B26B 19/143 |

FOREIGN PATENT DOCUMENTS

JP 2015-070927 A 4/2015

* cited by examiner

*Primary Examiner* — Ghassem Alie
(74) *Attorney, Agent, or Firm* — Manabu Kanesaka

(57) ABSTRACT

There is provided a rotary electric shaver which can easily prevent an outer blade which is undesirable to be brought into contact with a skin from coming into contact with the skin, by reducing the number of contact times of the outer blades in a head with the skin, even when the shaver is used in a state where the head is substantially parallel to the skin. A rotary electric shaver includes a main body having a drive shaft, and a head connected to the main body. At least one of a plurality of blade units has a fulcrum plate, a turning plate, a spring, and a fixing plate, and has a lock mechanism capable of changing a height position of at least one of outer blades corresponding one-to-one to the blade units.

8 Claims, 4 Drawing Sheets

ROTARY ELECTRIC SHAVER

CROSS-REFERENCE TO RELATED APPLICATION

This application is based upon and claims the benefit of priority of the prior Japanese Patent Application No. P2019-194880, filed on Oct. 28, 2019, and the entire contents of which are incorporated herein by reference.

TECHNICAL FIELD

The present invention relates to a rotary electric shaver.

BACKGROUND ART

A rotary electric shaver includes a main body having a built-in motor, and a head having a plurality of blade units having an outer blade having a circular shaving surface on an outer side and an inner blade rotating while sliding on an inner surface of the outer blade, and is configured so that the head is set in the main body.

In the related art, a configuration has been proposed in which an upper surface of the head is deformable into a convex position and a concave position (PTL 1: JP-A-2015-070927).

SUMMARY OF INVENTION

Technical Problem

A head of a commercially available rotary electric shaver including a technique in the related art disclosed in PTL 1 is configured so that all outer blades have the same height position, or is configured so that all of the outer blades are tilted in conjunction with each other. Therefore, when a user wants to partially cut and trim hairs beneath a nose or sideburns, the user wants that one or two of the outer blades come into contact with the user's skin, but does not want that the other outer blade comes into contact with the user's skin. Therefore, as an example, it is conceivable to adopt a method of using the rotary electric shaver by tilting the head. However, when the head is tilted, the skin is likely to enter a slit groove. Consequently, the user has more tingling feel on the skin due to contact between the skin and an inner blade. In addition, since the rotary electric shaver is used by tilting the head, there is a disadvantage in that usability is poor. That is, the usability is satisfactory when the rotary electric shaver is used in a state where the outer blade in the head is substantially parallel to the skin. However, the outer blade which is undesirable to be brought into contact with the skin out of a plurality of the outer blades comes into contact with the skin. Accordingly, in some cases, the hair is less likely to be cut in a desired manner.

Solution to Problem

In response to the above issue, one or more aspects of the present invention are directed to a rotary electric shaver having a structure which can easily prevent a possibility that an outer blade which is undesirable to be brought into contact with a skin out of a plurality of the outer blades may come into contact with the skin, by reducing the number of contact times of the outer blades in a head with the skin, even in a case where the rotary electric shaver is used in a state where the head is substantially parallel to the skin. In this invention, examples of the hairs include beards, mustache, whisker, and the like.

The present invention has been accomplished under the solutions as disclosed below.

According to the present invention, there is provided a rotary electric shaver including a main body having a drive shaft, and a head having a plurality of blade units having an outer blade, an inner blade rotating while sliding on an inner surface of the outer blade, and a driven shaft that rotates the inner blade, having a built-in transmission drive system that transmits driving power of the drive shaft to rotate the driven shaft, and connected to the main body. At least one of the blade units is internally equipped with a fulcrum plate having a ring part in which first sloped parts are formed at a predetermined interval, a turning plate having tube parts in which second sloped parts are formed on an upper side at a predetermined interval and which engage with the fulcrum plate, a fixing plate having a through-hole into which the tube part is insertable, and a spring disposed in the fixing plate to press the turning plate in a pressing-up direction, and at least one of the outer blades corresponding one-to-one to the blade units has a lock mechanism capable of changing a height position.

According to this configuration, when the first outer blade of the outer blades corresponding to the blade unit or a peripheral part of the first outer blade is pressed down by a predetermined amount to be released by the lock mechanism, the height position of the first outer blade is lower than the height position of the second outer blade. Therefore, it is possible to easily prevent a possibility that the outer blade which is undesirable to be brought into contact with the skin out of the outer blades may come into contact with the skin, by reducing the number of contact times of the outer blades in the head with the skin.

It is preferable that the lock mechanism is configured as follows. When a first outer blade of the outer blades is pressed down by a predetermined amount to be released in a direction in which the spring is compressed, the turning plate turns around an axis by a predetermined amount, an engagement position between the first sloped part and the second sloped part is moved, the first outer blade is moved from a first height position to a second height position, and is located lower than a second outer blade of the outer blades. When the first outer blade is pressed down and released again by the predetermined amount in the direction in which the spring is compressed, the turning plate turns around the axis by the predetermined amount, the engagement position between the first sloped part and the second sloped part is moved, the first outer blade is moved from the second height position to the first height position, and is located at a height the same as that of the second outer blade of the outer blades. According to this configuration, the height position of the first outer blade can be changed with one touch.

Advantageous Effects of Invention

According to the present invention, it is possible to realize the rotary electric shaver having a structure capable of easily preventing a possibility that the outer blade which is undesirable to be brought into contact with the skin out of the outer blades may come into contact with the skin, by reducing the number of contact times of the outer blades in the head with the skin, even in a case where the rotary electric shaver is used in a state where the head is substantially parallel to the skin.

DESCRIPTION OF EMBODIMENTS

Figure 1:
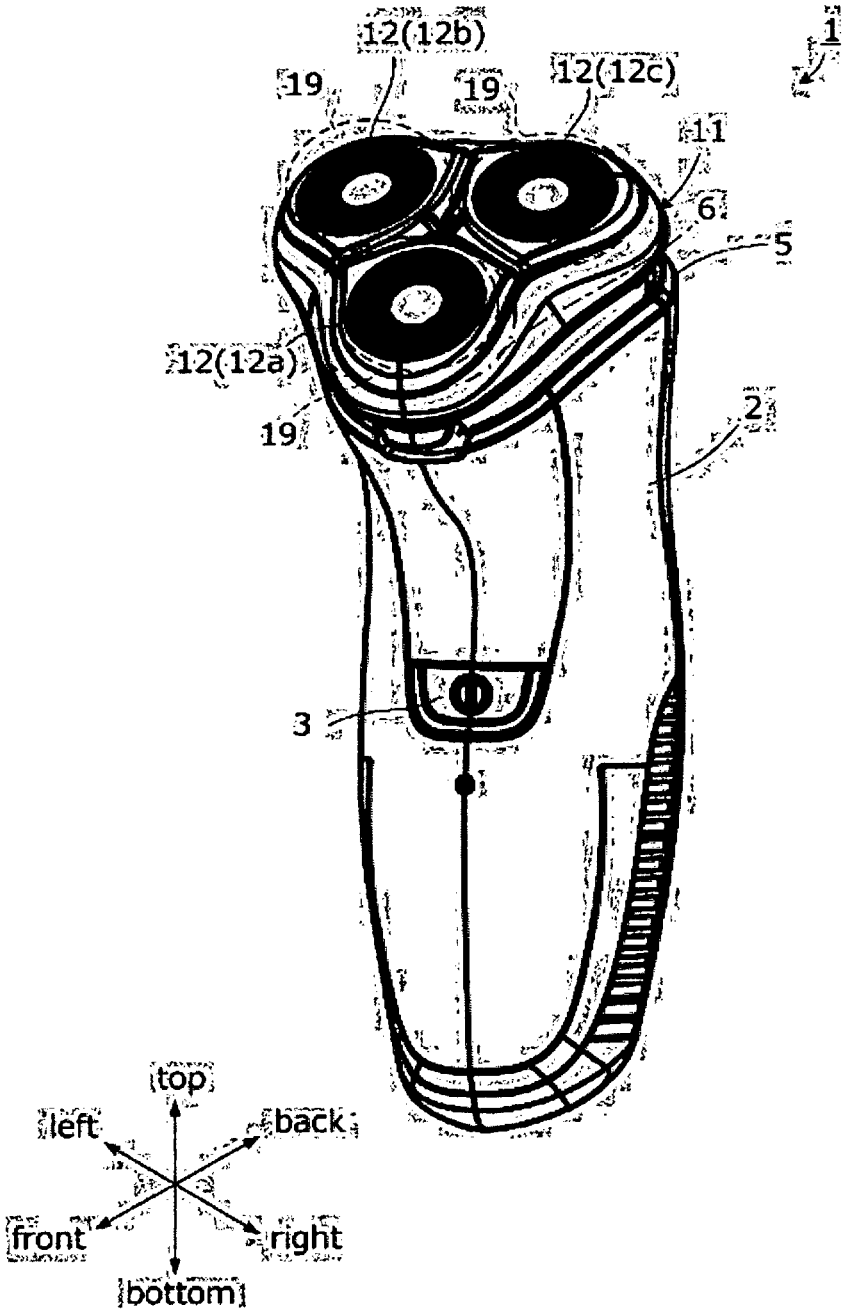
FIG. 1 is a schematic perspective view illustrating an example of a rotary electric shaver according to an embodiment of the present invention.

Hereinafter, an embodiment according to the present invention will be described in detail with reference to the drawings. As an example, the present embodiment relates to a rotary electric shaver 1 having a head 11 having a plurality of blade units 19. In FIG. 1, hereinafter, the rotary electric shaver 1 may be simply referred to as an "electric shaver" in some cases. In all the drawings for describing the embodiment, the same reference numerals will be assigned to members having the same function, and repeated description thereof may be omitted in some cases.

As illustrated in FIG. 1, as an example, the electric shaver 1 includes a main body 2 gripped by a user, and a head 11 detachably connected to a connection part 5 disposed in the main body 2. As an example, the head 11 is connected to the main body 2 to be capable of tilting.

A front surface side of the main body 2 is an operation panel, and a power switch 3 is disposed thereon as an example. The main body 2 has a motor, a power supply unit that supplies electricity to the motor, and a built-in control unit (not illustrated) that controls the motor and the power supply unit, and a technique in the related art is applicable to the main body 2.

The head 11 includes a plurality of blade units 19 having a cap-shaped outer blade 12 having a circular shaving surface on an outer side, an outer blade setting part 25 that sets the outer blade 12, an inner blade 13 rotating while sliding on an inner surface of the outer blade 12, and a driven shaft 14 that rotates the inner blade 13. In the present embodiment, three blade units 19 are disposed at an equal interval in a circumferential direction around a center of the head 11 in a plan view. Without being limited to the above-described configuration, in some cases, two blade units 19 may be disposed at the equal interval in the circumferential direction around the center of the head 11 in a plan view. The head 11 according to the present embodiment has a blade frame 15 that holds the blade unit 19 to be capable of swing movement, and a blade setting base 17 that holds the blade frame 15. As an example, the blade units 19 are capable of being independently pressed down. Here, the blade unit 19 is set in the fulcrum plate 21, and is held by the blade frame 15 via the fulcrum plate 21, the turning plate 22, the spring 23, and the fixing plate 24.

Figure 2A:
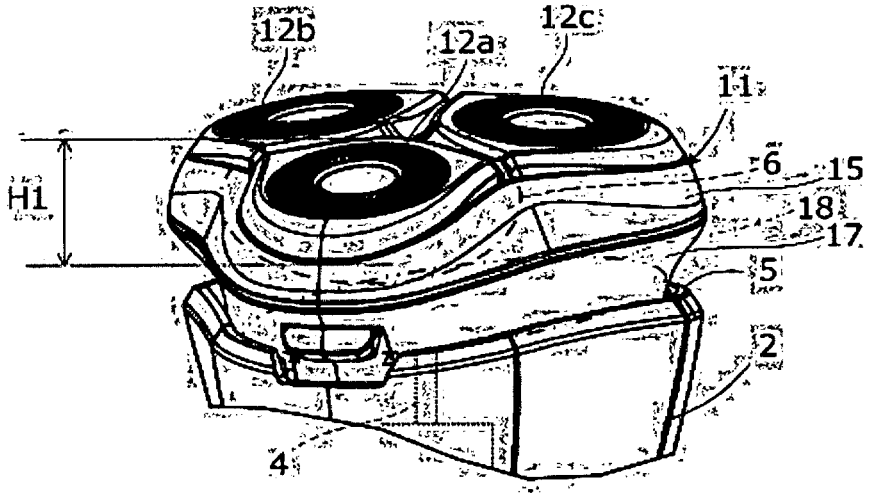
FIG. 2A is a schematic perspective view illustrating an example in a state where a height position of a first outer blade is the same as a height position of a second outer blade in a head in FIG. 1.
Figure 2B:
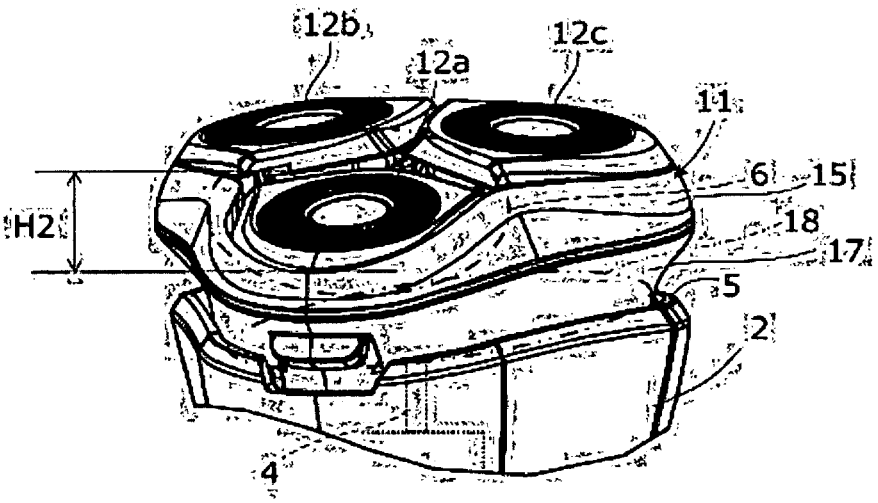
FIG. 2B is a schematic perspective view illustrating an example in a state where the height position of the first outer blade is lower than the height position of the second outer blade in the head in FIG. 1.

At least one of the blade units 19 has a lock mechanism 6. In the example in FIGS. 2A and 2B, one of the blade units 19 includes the lock mechanism 6. As an example, in the lock mechanism 6, when a first outer blade 12*a* or a peripheral part of the first outer blade 12*a* is pressed down by a predetermined amount to be released, the first outer blade 12*a* is moved from a first height position H1 to a second height position H2, and is located lower than a second outer blade 12*b* and a third outer blade 12*c*. When the first outer blade 12*a* or the peripheral part of the first outer blade 12*a* is pressed down and released again by the predetermined amount, the first outer blade 12*a* is moved from the second height position H2 to the first height position H1, and is located at a height the same as that of the second outer blade 12*b* and the third outer blade 12*c*. The first height position H1 is a position where the first outer blade 12*a* is located highest. There are a case where the outer blade setting part 25 is located at a height the same as that of the blade frame 15, and a case where the outer blade setting part 25 is located higher than the blade frame 15. Here, the second height position H2 is a position where the height of the first outer blade 12*a* is lower than that of the second outer blade 12*b* or the third outer blade 12*c*.

Figure 3:
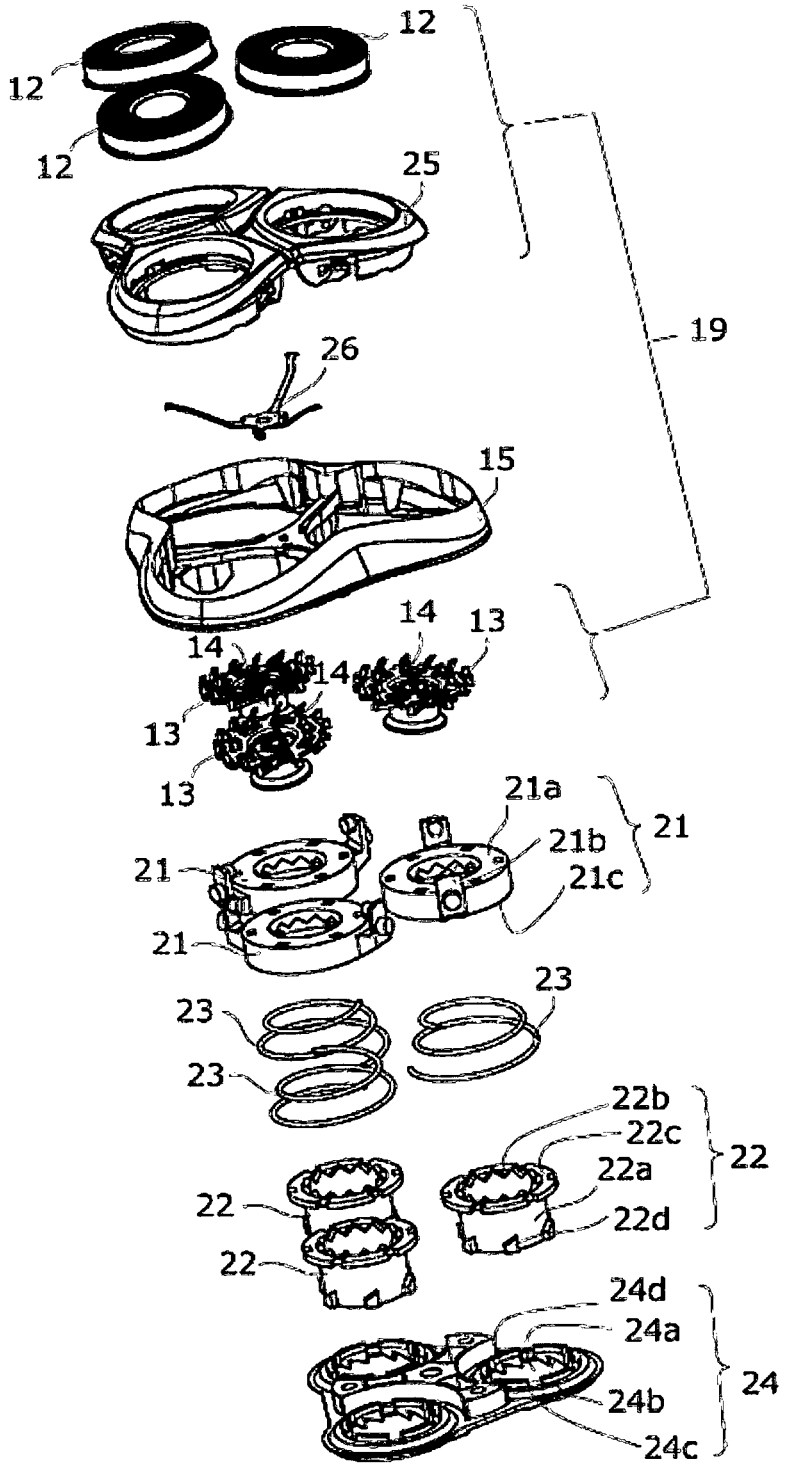
FIG. 3 is a schematic structural development view of the head.

FIG. 3 is a schematic structural development view of the head 11. The outer blade 12 is set in the outer blade setting part 25, and the blade unit 19 is set in the fulcrum plate 21. The outer blade setting part 25 is pressed up by being pressed due to a restoring force of the plate-shaped spring 26 disposed in the blade frame 15. The head 11 has a built-in first transmission drive system 18 adopting a gear drive type that transmits the driving power of the drive shaft 4 to rotate the driven shaft 14. The driven shaft 14 causes the inner blade 13 to rotate while sliding on the inner surface of the outer blade 12. As an example, the lock mechanism 6 is configured so that the fulcrum plate 21, the turning plate 22, the spring 23, and the fixing plate 24 are sequentially combined from above. The spring 23 is disposed in the fixing plate 24, and presses the turning plate 22 in a pressing-up direction.

The fulcrum plate 21 has a ring part 21*a*, and first sloped parts 21*b* are formed at a predetermined interval inside the ring part 21*a*. As an example, in the first sloped part 21*b*, triangular convex parts facing downward in a side view are formed at a predetermined interval. In addition, a claw part 21*c* is formed on a lower side of the fulcrum plate 21.

The turning plate 22 has a tube part 22*a*, a flange 22*c* is formed on an upper side of the tube part 22*a*, and second sloped parts 22*b* are formed at a predetermined interval on an upper side of the flange 22*c*. As an example, in the second sloped part 22*b*, triangular convex parts facing upward in a side view are formed at a predetermined interval. The first sloped part 21*b* and the second sloped part 22*b* engage with each other, and the turning plate 22 is capable of turning around an axis. The flange 22*c* engages with the claw part 21*c* to retain the turning plate 22. In the turning plate 22, third sloped parts 22*d* are formed at a predetermined interval on a lower side of the tube part 22*a* by outward projections. As an example, in the third sloped part 22*d*, triangular convex parts facing upward in a side view are formed at a predetermined interval.

The fixing plate 24 has a through-hole 24*a* into which the tube part 22*a* can be inserted. In the fixing plate 24, fourth sloped parts 24*b* are formed at a predetermined interval on a lower side by downward projections. First groove parts 24*c* are formed at a predetermined interval in an upward-downward direction between the fourth sloped part 24*b* and the fourth sloped part 24*b*. A second groove part 24*d* is formed on an upper side of the fourth sloped part 24*b*. As an example, in the fourth sloped part 24*b*, triangular convex parts facing downward in a side view are formed at a predetermined interval. The third sloped part 22*d* and the fourth sloped part 24*b* engage with each other, and the turning plate 22 is capable of turning around the axis. As an example, the first groove part 24*c* is formed in a slit shape which is continuous from an upper end to a lower end. The third sloped part 22*d* engages with the first groove part 24*c* to be capable of sliding in the upward-downward direction. On the upper side of the first groove part 24*c*, the turning plate 22 engages with the second groove part 24*d* to be capable of sliding in the circumferential direction.

The spring 23 according to the present embodiment is a coil spring. In this manner, it is possible to prevent the springs 23 from interfering with each other when the springs 23 are compressed. Accordingly, the lock mechanism 6 can have a stable operation and excellent reliability. As an example, the spring 23 is a conical coil spring. In this manner, a space can be easily saved in the upward-downward direction. Without being limited to the above-described configuration, as an example, a plate-shaped spring is also applicable.

Figure 4A:
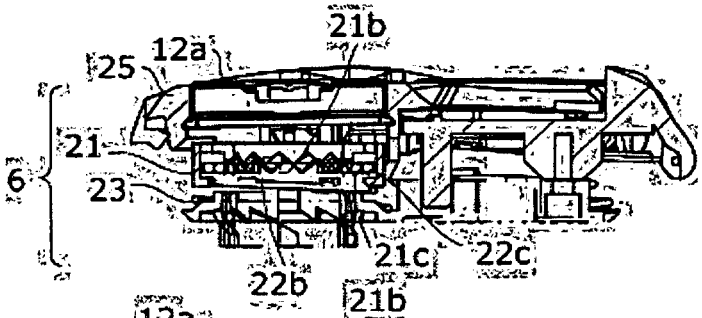
FIGS. 4A to 4E are schematic sectional views for describing an operation of a lock mechanism.
Figure 4B:
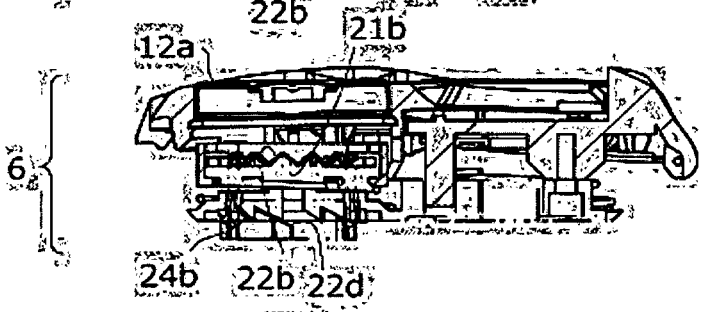
Figure 4C:
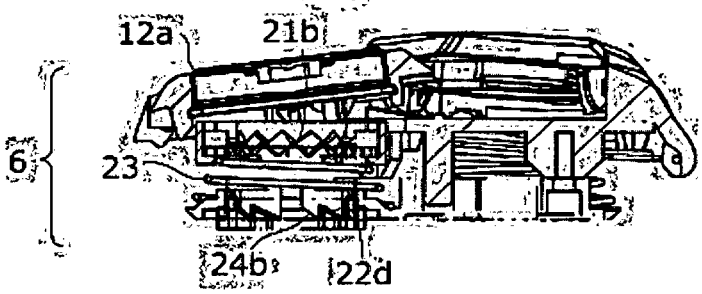
Figure 4D:
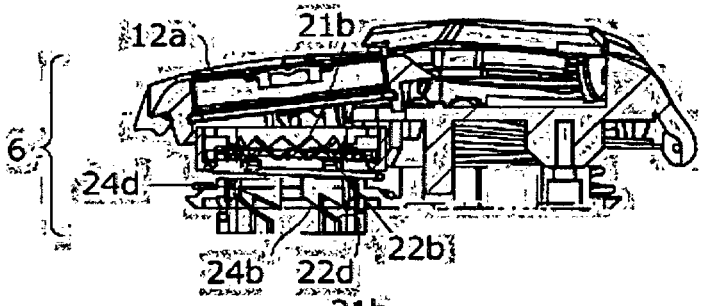
Figure 4E:
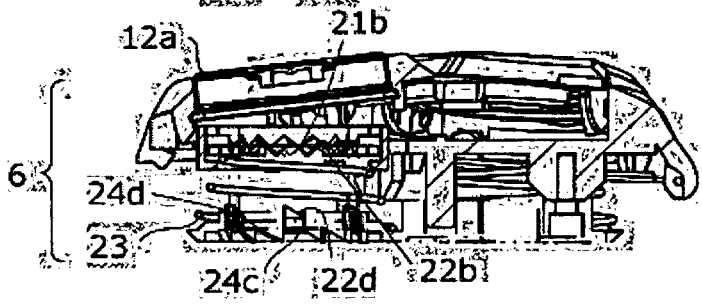

FIGS. 4A to 4E are schematic sectional views for describing an operation of the lock mechanism 6. As illustrated in FIG. 4A, when the first outer blade 12*a* is lowered, the fulcrum plate 21 and the turning plate 22 are lowered. The second sloped part 22*b* is pressed down by the first sloped part 21*b*. Accordingly, tension is applied to the turning plate 22 in one direction. The third sloped part 22*d* and the fourth sloped part 24*b* disengage from each other, thereby bringing the turning plate 22 into a state illustrated in FIG. 4B. Then, the released turning plate 22 moves upward while rotating. The first outer blade 12*a* moves upward in conjunction with the turning plate 22. The turning plate 22 engages with the second groove part 24*d* of the fixing plate 24. The height of the first outer blade 12*a* is lower than the height before the movement of the first outer blade 12*a*, thereby bringing the turning plate 22 into a state illustrated in FIG. 4C. At this time, the position of the spring 23 is fixed between the fixing plate 24 and the turning plate 22, and the first outer blade 12*a* is pressed up in an upward direction by the inner blade 13. The fulcrum plate 21 and the turning plate 22 have a retainer. Accordingly, a movable range of the first outer blade 12*a* in the upward-downward direction is restricted.

When the first outer blade 12*a* is lowered again, the fulcrum plate 21 and the turning plate 22 are lowered. The second sloped part 22*b* is pressed down by the first sloped part 21*b*. Accordingly, tension is applied to the turning plate 22 in one direction. The third sloped part 22*d* and the fourth sloped part 24*b* disengage from each other, thereby bringing the turning plate 22 into a state illustrated in FIG. 4D. The released turning plate 22 moves upward while rotating. The first outer blade 12*a* moves upward in conjunction with the turning plate 22. A restoring force of the spring 23 causes the first outer blade 12*a* to return to an initial position, thereby bringing the turning plate 22 into a state illustrated in FIG. 4E.

In the lock mechanism 6 according to the present embodiment, when the first outer blade 12*a* is pressed down by a predetermined amount to be released in the direction in which the spring 23 is compressed, the turning plate 22 turns around the axis by a predetermined amount, the engagement position between the first sloped part 21*b* and the second sloped part 22*b* moves, the third sloped part 22*d* engages with the second groove part 24*d*, the height position of the first outer blade 12*a* is located at the second height position H2, and the first outer blade 12*a* is located lower than the second outer blade 12*b*. Then, when the first outer blade 12*a* is pressed down again by a predetermined amount to be released in the direction in which the spring 23 is compressed, the turning plate 22 turns around the axis by a predetermined amount, the engagement position between the first sloped part 21*b* and the second sloped part 22*b* moves, the third sloped part 22*d* engages with the first groove part 24*c*, the first outer blade 12*a* moves from the second height position H2 to the first height position H1, and the first outer blade 12*a* is located at the height the same as that of the second outer blade 12*b*. Then, the blade unit 19 is capable of swing movement at both the first height position H1 and the second height position H2. That is, not only when the first outer blade 12*a* is located at the height the same as that of the second outer blade 12*b*, but also when the first outer blade 12*a* is located at the height lower than that of the second outer blade 12*b*, the plurality of inner blades 13 can be rotated to shave the hair.

According to the above-described embodiment, when a user wants to partially cut and trim the hair beneath the nose or sideburns, in a case where the rotary electric shaver is used in a state where the head 11 is substantially parallel to the skin, the user can easily prevent a possibility that the first outer blade 12*a* which is undesirable to be brought into contact with the skin out of the outer blades 12 may come into contact with the skin, by reducing the number of contact times of the outer blades 12 in the head 11 with the skin.

The present invention is not limited to the embodiments described above, and various modifications can be made within the scope not departing from the present invention.

What is claimed is:

1. A rotary electric shaver, comprising:

a main body having a drive shaft, a head connected to the main body, and having a plurality of blade units, each having an outer blade, an inner blade rotating while sliding on an inner surface of the outer blade, and a driven shaft that rotates the inner blade, and a built-in transmission drive system that transmits driving power of the drive shaft to rotate the driven shaft, and a lock mechanism provided in at least one of the plurality of blade units and changing a height of the outer blade between a first position and a second position lower than the first position, the lock mechanism including a fulcrum plate having a ring part with first sloped parts formed on an inner side thereof at a predetermined interval;

a turning plate having a tube part with second sloped parts formed on one side at a predetermined interval and engaging with the fulcrum plate, and third sloped parts formed on another side at a predetermined interval and having outward projections;

a fixing plate having a through-hole for receiving the tube part therein, and fourth sloped parts formed on one side thereof at a predetermined interval and having downward projections; and a spring disposed in the fixing plate to press the turning plate in a pressing-up direction, wherein when the outer blade is pressed down against a force of the spring by a predetermined amount and is released, the turning plate turns around an axis thereof so that the first sloped parts and the second sloped parts engage and the outer blade rotates at the second height, and when the outer blade is pressed down again by a predetermined amount and is released, the turning plate turns around the axis so that the first sloped parts and the second sloped parts engage and the outer blade is moved from the second height position to the first height position and rotates at the first height.

2. The rotary electric shaver according to claim 1, wherein the turning plate has a flange formed on an upper side, the fulcrum plate has a claw part formed on a lower side, and the flange engages with the claw part so that the turning plate is restricted from an upward-downward direction.

3. The rotary electric shaver according to claim 1, wherein the fixing plate further includes first groove parts formed at a predetermined interval in an upward-downward direction between the fourth sloped parts, and a second groove part formed on upper sides of the fourth sloped parts, and wherein the turning plate engages with the first groove parts so that the first outer blade is located at the first position, and the turning plate engages with the second groove parts so that the first outer blade is located at the second position.

4. The rotary electric shaver according to claim 1, wherein the spring has a conical coil shape.

5. The rotary electric shaver according to claim 1, wherein the head is connected to the main body, the head further has a blade frame that holds the blade units and a blade setting base that holds the blade frame.

6. The rotary electric shaver according to claim 1, wherein one of the plurality of blade units includes the lock mechanism, and another of the plurality of blade units does not have the lock mechanism and is located at the first height.

7. The rotary electric shaver according to claim 1, wherein the plurality of blade units includes a first blade unit, a second blade unit, and a third blade unit having the lock mechanism.

8. The rotary electric shaver according to claim 7, wherein the head further includes a blade frame that holds the blade units, and a blade setting base that holds the blade frame, and the third blade unit swings in a state when the lock mechanism is in the first position and the second position.

* * * * *